US009758285B2

(12) United States Patent
Brooks

(10) Patent No.: US 9,758,285 B2
(45) Date of Patent: Sep. 12, 2017

(54) BAG IN BOX PACKAGING HAVING AN INSERTED PANEL FOR RECEIVING A SPOUT OF THE BAG FOR CORNER DISPENSING

(71) Applicant: Scholle Corporation, Irvine, CA (US)

(72) Inventor: John Brooks, Leabrook (AU)

(73) Assignee: Scholle IPN Corporation, Northlake, IL (US)

( * ) Notice: Subject to any disclaimer, the term of this patent is extended or adjusted under 35 U.S.C. 154(b) by 324 days.

(21) Appl. No.: 14/457,047

(22) Filed: Aug. 11, 2014

(65) Prior Publication Data

US 2015/0041495 A1 Feb. 12, 2015

Related U.S. Application Data

(60) Provisional application No. 61/864,380, filed on Aug. 9, 2013.

(51) Int. Cl.

| | |
|---|---|
| ***B65D 77/06*** | (2006.01) |
| ***B65D 5/46*** | (2006.01) |
| ***B67D 3/00*** | (2006.01) |
| ***B65D 75/58*** | (2006.01) |

(52) U.S. Cl.

CPC ..... *B65D 77/068* (2013.01); *B65D 75/5877* (2013.01); *B67D 3/0067* (2013.01)

(58) Field of Classification Search

CPC B65D 77/068; B65D 75/5877; B65D 77/067; B65D 5/46008; B65D 77/065; B65D 77/062; B65D 5/606; B67D 3/0067; B67D 2001/0827

USPC ..... 229/117.27, 117.24, 117.3, 117.35; 222/563, 105, 185.1, 92; 220/495.05; 383/906

See application file for complete search history.

(56) References Cited

U.S. PATENT DOCUMENTS

| | | | | |
|---|---|---|---|---|
| 2,571,199 | A * | 10/1951 | Butler | B65D 5/703 222/543 |
| 3,089,622 | A * | 5/1963 | Westlake, Jr. | B65D 77/065 222/183 |
| 3,233,817 | A | 2/1966 | Casady | |
| 3,253,764 | A * | 5/1966 | Goetschius | B65D 5/0236 222/105 |
| 3,952,940 | A * | 4/1976 | Malcolm | B65D 5/703 229/117.16 |

(Continued)

*Primary Examiner* — Christopher Demeree

(74) *Attorney, Agent, or Firm* — The Watson I.P. Group, PLC; Jovan N. Jovanovic; Vladan M. Vasiljeuic

(57) ABSTRACT

The bag in box packaging comprising an inner bag, an outer carton and an inner spout retaining member. The inner bag defines a cavity with a spout coupled thereto. The outer carton includes a front wall and a first sidewall positioned adjacent the front wall, both extending from a bottom wall to a top wall. The inner spout retaining member including a first panel spanning diagonally from the first sidewall to the front wall obliquely relative to each wall and spaced apart from a side edge joining the front wall to the first sidewall, to define a triangular cross-sectional configuration. The first panel includes a spout retaining slot extending thereinto. The spout extends into the spout receiving slot so as to capture the spout within the cross-sectional configuration and directed toward the side edge. The inner bag is positioned on the opposite side of the first panel.

16 Claims, 8 Drawing Sheets

(56) References Cited

U.S. PATENT DOCUMENTS

| | | | | |
|---|---|---|---|---|
| 5,193,712 | A * | 3/1993 | Kuppersbusch ..... | B65D 77/062<br>229/117.3 |
| 7,681,783 | B2 | 3/2010 | Stephenson | |

* cited by examiner

BAG IN BOX PACKAGING HAVING AN INSERTED PANEL FOR RECEIVING A SPOUT OF THE BAG FOR CORNER DISPENSING

CROSS-REFERENCE TO RELATED APPLICATION

This application claims priority from U.S. Provisional Patent Application Ser. No. 61/864,380 filed Aug. 9, 2013, entitled "Bag In Box Packaging Having An Inserted Panel For Receiving A Spout Of The Bag for Corner Dispensing," the entire specification of which is incorporated by reference.

BACKGROUND OF THE DISCLOSURE

1. Field of the Disclosure

The disclosure relates in general to bag in box packaging, and more particularly, to a bag in box packaging that has an inserted panel for receiving a spout of the bag for corner dispensing.

2. Background Art

The use of bag in box packaging is ubiquitous. In certain applications, a user can dispense flowable material through a tap directly from the bag in box packaging. One such application is wine dispensing, although, the invention is not limited to the same.

Conventionally, a bag having a fluid therewithin (such as, for example, wine) is provided. A tap is provided over a spout that is welded to the bag. The tap may comprise any number of different spouts that are conventionally used in such an application. The filled bag is dropped into an outer box. The outer box includes a removable portion which corresponds to the location of the tap within the outer box.

To access the tap, the user punctures the box proximate the removable portion and reaches into the box for the tap. The tap is then directed out of the box and one of the tap and the spout are coupled to the box. The tap can then be actuated to dispense product.

Problematically, for some users it is difficult to couple the tap to the outer box. Thus, the tap becomes difficult, if not impossible to use. In other instances, the tap may become dislodged from the outer box during use.

In addition, due to the manner in which the tap and bag are inserted into the outer box, there are many instances where the tap lies in an orientation which is difficult to reach. Furthermore, inasmuch as the opening in the box is typically used to secure the tap to the outer box, the opening is often too small to allow for a user to delve deeply into the outer box.

SUMMARY OF THE DISCLOSURE

The disclosure is directed to a bag in box packaging. The bag in box packaging comprising an inner bag, an outer carton and an inner spout retaining member. The inner bag defines a cavity with a spout coupled thereto which provides communication with the cavity. The outer carton includes a front wall and a first sidewall positioned adjacent the front wall, both extending from a bottom wall to a top wall. The inner spout retaining member including a first panel spanning diagonally from the first sidewall to the front wall obliquely relative to each wall and spaced apart from a side edge joining the front wall to the first sidewall, to, in turn, define a generally triangular cross-sectional configuration therebetween. The first panel includes a spout retaining slot extending thereinto. The spout of the inner bag is configured to extend into the spout receiving slot so as to capture the spout within the cross-sectional configuration and directed toward the side edge. The inner bag is positioned on the opposite side of the first panel.

In some configurations, the bag inbox packaging further includes a member for locking the spout within the spout receiving slot.

In some configurations, the member for locking the spout comprises a bottom encapsulating panel that extends from the bottom wall and includes a spout locking slot that engages the spout when the spout is positioned within the spout receiving slot. Thus, the spout is sandwiched therebetween.

In some configurations, the first panel extends from the bottom wall to the top wall.

In some configurations, the first panel of the inner spout retaining member is generally perpendicular to the bottom wall.

In some configurations, each of the front wall, the first sidewall and the first panel of the inner spout retaining member are perpendicular to the bottom wall.

In some configurations, the front wall, the bottom wall and the first sidewall further include a frangible portion. It will be understood that through removal of the frangible portion the spout becomes accessible through an opening defined thereby.

In some configurations, the spout receiving slot includes an opening that is proximate the bottom wall.

In some configurations, the spout receiving slot comprises a slot that extends from a bottom edge of the first panel toward the top wall.

In some configurations, the inner spout retaining member further comprises a sidewall engaging panel coupled to one side of the first panel and a front wall engaging panel coupled to the other side of the first panel.

In some configurations, the outer carton is formed from a single blank of material.

In some configurations, a triangular cutout is formed between the front wall and the first sidewall proximate the bottom wall. A pair of triangular folds are formed above the opening. The triangular folds abut each other about the side edge, and, the triangular folds may be directed inwardly toward the first panel.

In some configurations, openings are disposed along the side edge to facilitate grasping by a user for purposes of dispensing.

In some configurations, a tap is coupled to the spout of the inner bag.

In some configurations, the triangular cross-sectional area comprises a right triangle with each of the remaining angles being equal.

In some configurations, the outer carton forms a generally rectangular cubic configuration.

BRIEF DESCRIPTION OF THE DRAWINGS

The disclosure will now be described with reference to the drawings wherein.

DETAILED DESCRIPTION OF THE DISCLOSURE

Figure 1:
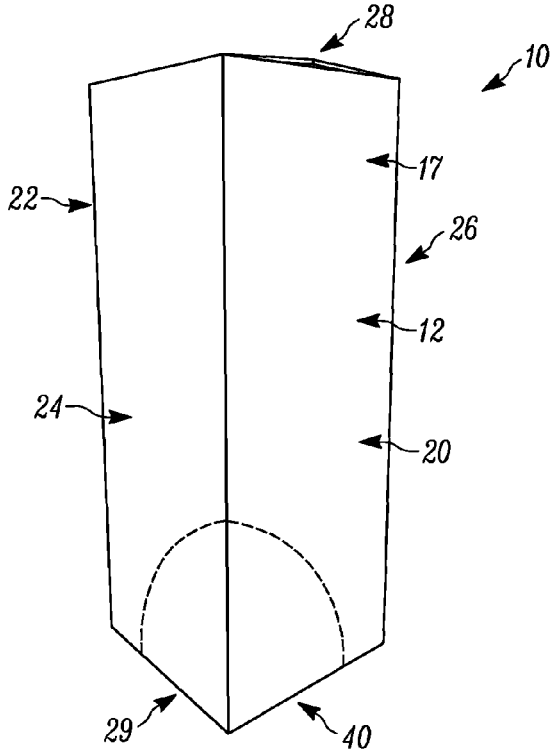
FIG. 1 of the drawings is a perspective view of the bag in box packaging of the present disclosure.
Figure 2:
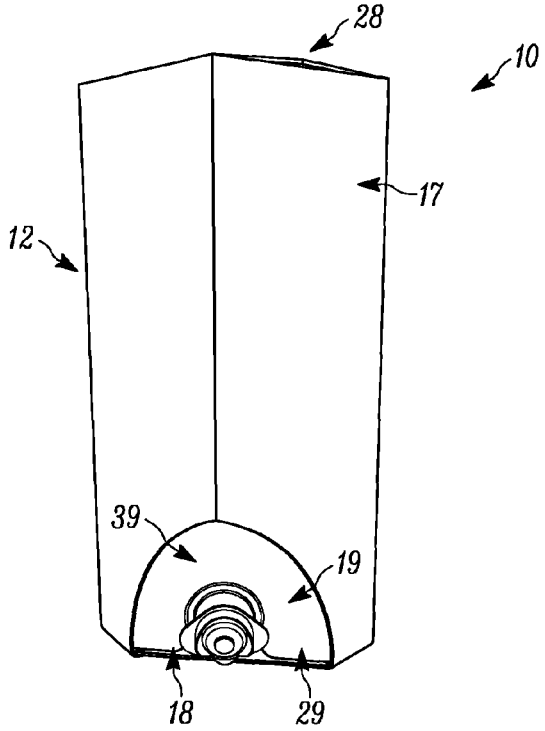
FIG. 2 of the drawings is a perspective view of the bag in box packaging of the present disclosure, with the frangible portion being removed exposing the tap.
Figure 3:
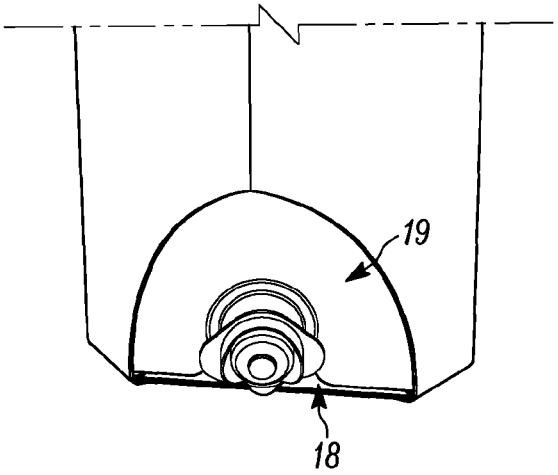
FIG. 3 of the drawings is a partial perspective view of the bag in box packaging of the present disclosure, with the frangible portion being removed exposing the tap.
Figure 4:
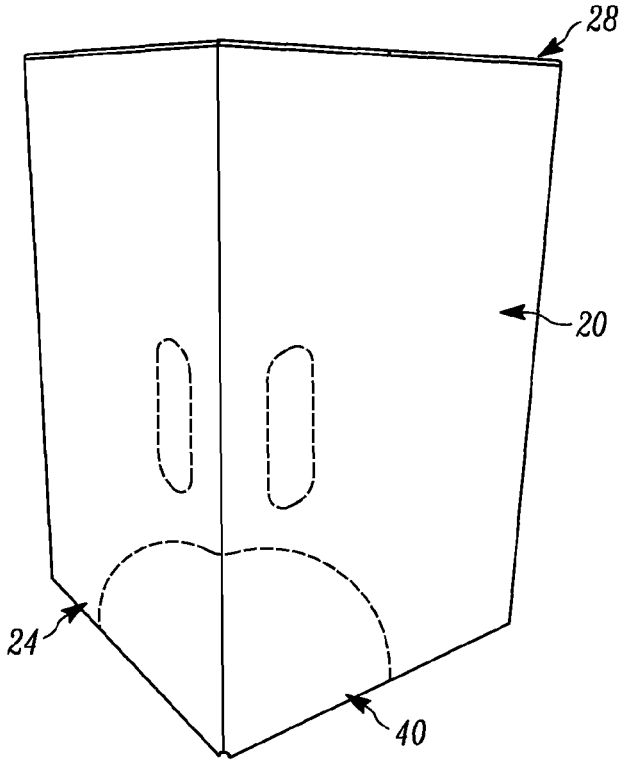
FIG. 4 of the drawings is a perspective view of another embodiment of the bag in box packaging of the present disclosure.
Figure 5:
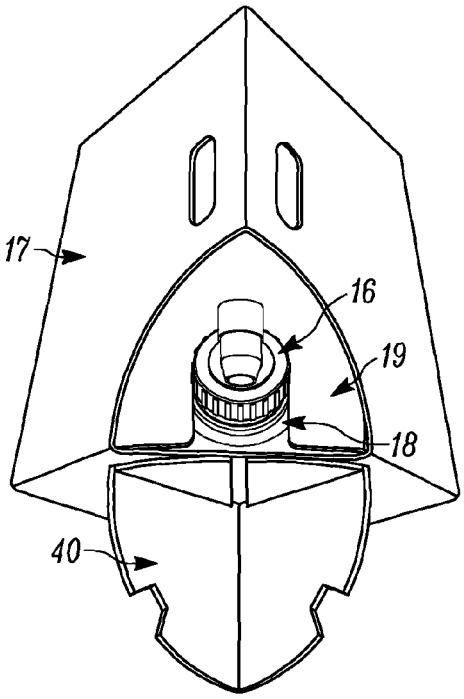
FIG. 5 of the drawings is a perspective view of another embodiment of the bag in box packaging of the present disclosure, showing in particular, the frangible portion removed.
Figure 6:
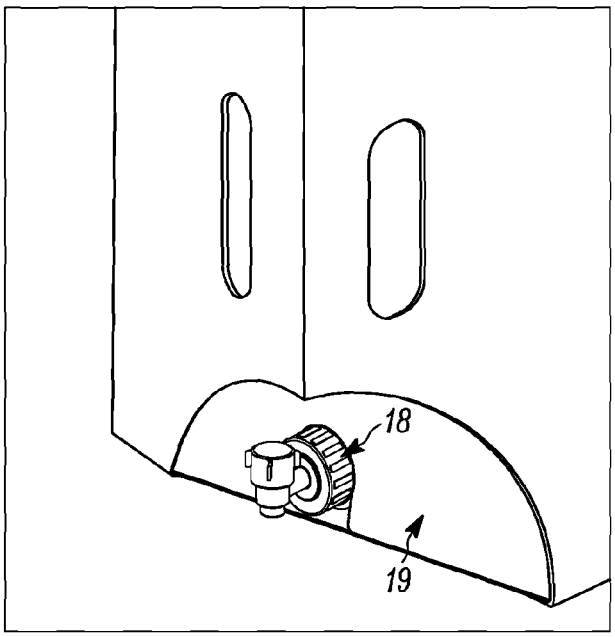
FIG. 6 of the drawings is a partial perspective view of another embodiment of the bag in box packaging of the present disclosure, showing the frangible portion removed.
Figure 7:
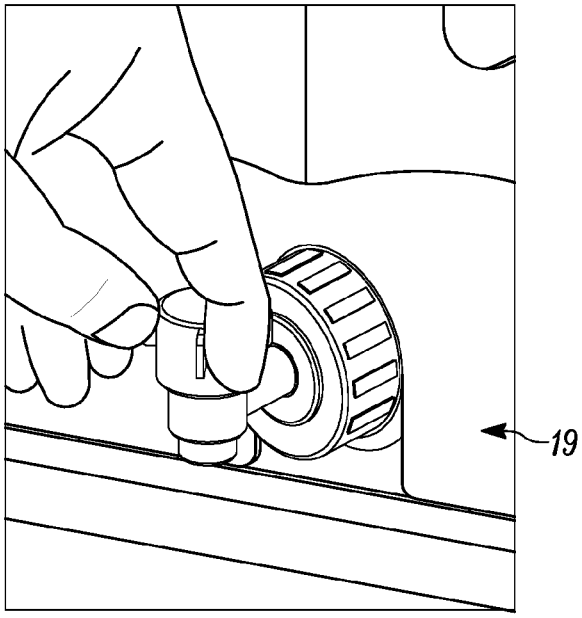
FIG. 7 of the drawings is a partial perspective view of another embodiment of the bag in box packaging of the present disclosure, showing use of the tap.
Figure 8:
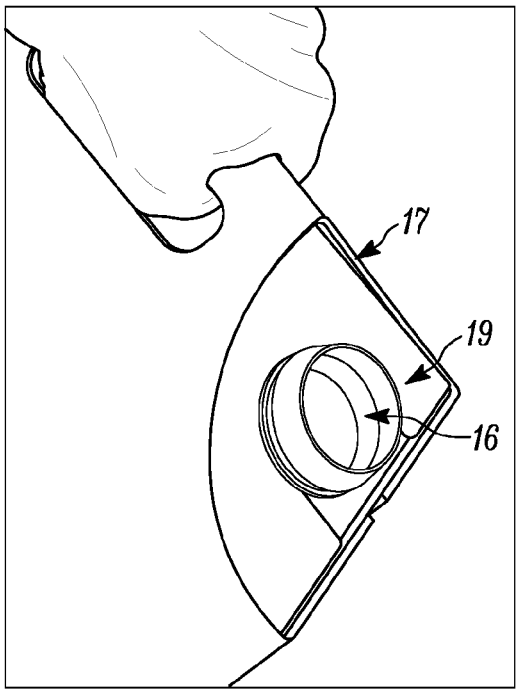
FIG. 8 of the drawings is a partial perspective view of another embodiment of the bag in box packaging of the present disclosure, showing the tap removed for pouring through use of the handle formed in the front wall and the first sidewall.
Figure 9:
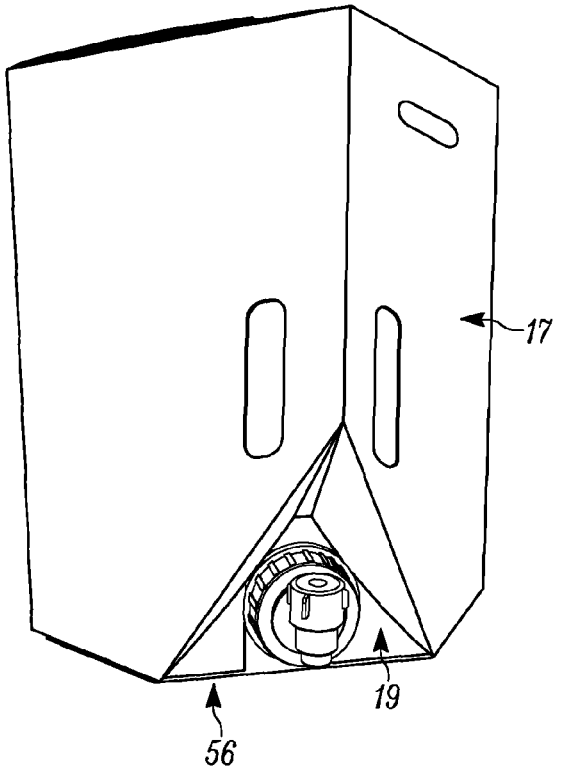
FIG. 9 of the drawings is a perspective view of yet another embodiment of the present disclosure.
Figure 10:
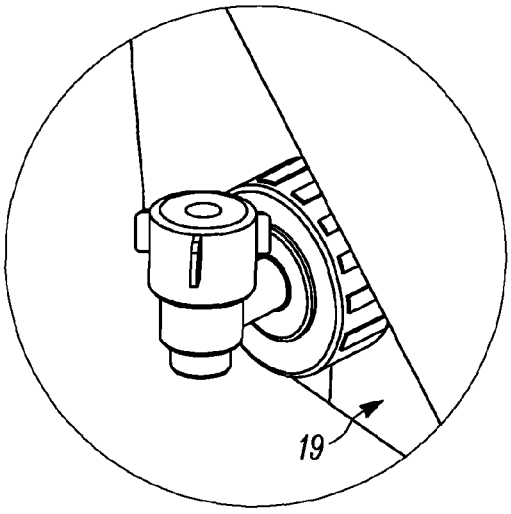
FIG. 10 of the drawings is a partial perspective view of the embodiment of FIG. 9, showing, in particular, the tap and the folded triangular structure therearound.
Figure 11:
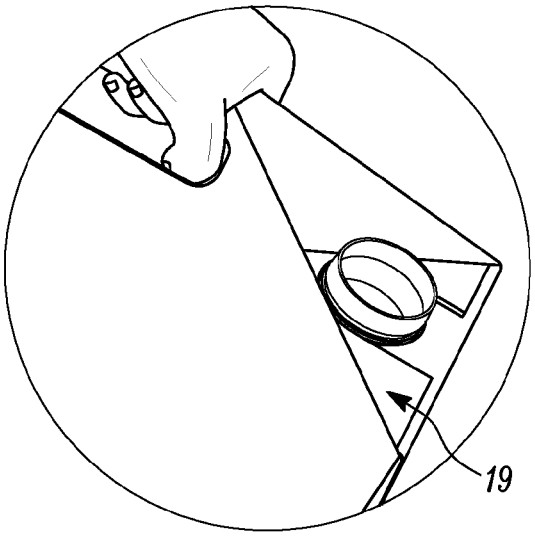
FIG. 11 of the drawings is a perspective view of the embodiment of FIG. 9, showing a pouring configuration with the tap removed.
Figure 12:
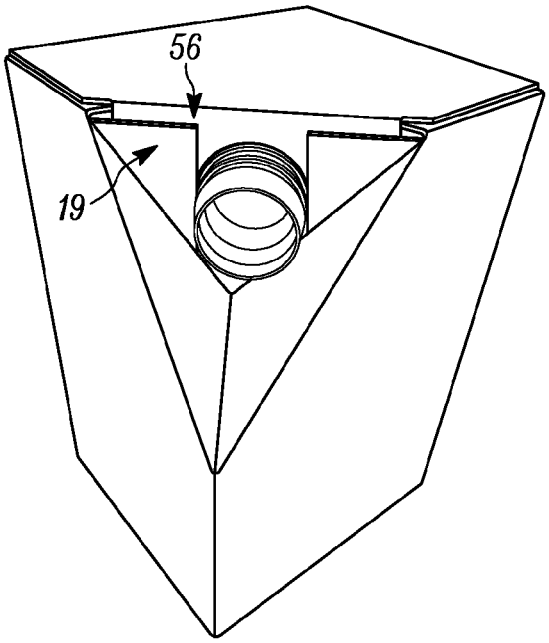
FIG. 12 of the drawings is a perspective view of the embodiment of FIG. 9, showing an inverted configuration, with the spout at an upper corner.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1 through 8, bag in box packaging 10 is shown in FIG. 1 as comprising outer carton 12, inner bag 16 (FIG. 15), and tap 18. The outer carton 12 is shown as comprising outer walls 17 and inner spout retaining member 19. Generally, the outer carton 12 is formed from a corrugated paperboard material. Of course, other materials, such as non-corrugated paperboard as well as different polymer sheeting materials (corrugated and non-corrugated) are likewise contemplated. Additionally, other formed materials that can be formed into such configurations are contemplated for use.

Figure 13:
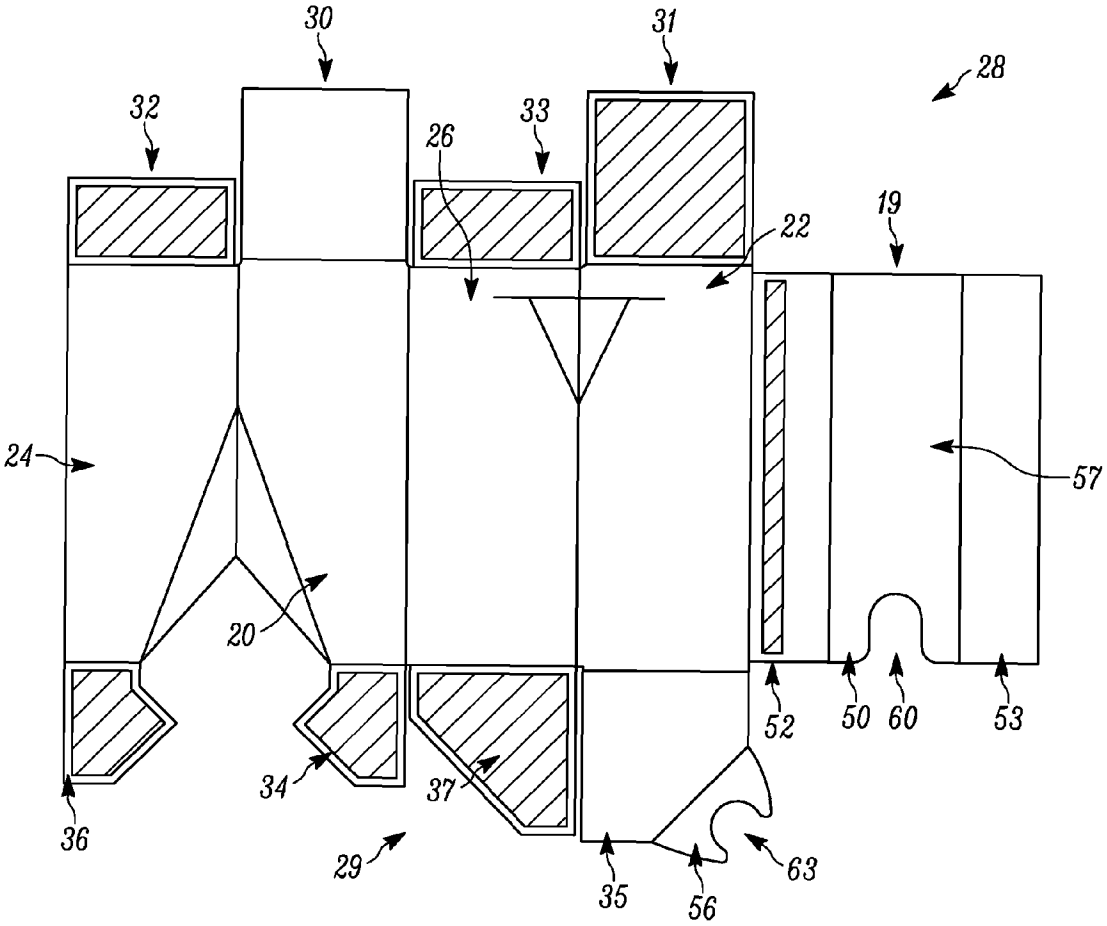
FIG. 13 of the drawings is a top plan view of a blank of the outer carton of the present disclosure.

With additional reference to FIG. 13 (which is a slightly different embodiment), the outer walls 17 form a generally rectangular cubic configuration, although other configurations are likewise contemplated (such as, for example, square configurations as well as configurations that are polygonal, trapezoidal, etc.). In the configuration shown in FIG. 1, the outer walls 17 include front wall 20, back wall 22, first sidewall 24, second sidewall 26 top wall structure 28 and bottom wall structure 29. The walls abut each other at edges, and the edges meet at corners. It will be understood that the first and second sidewalls span between the front wall and the back wall on opposing sides of each other. The top wall structure closes the upper portion of the carton with the bottom wall structure forming the lower portion of the carton. It will be understood that the outer walls 17 are formed from a blank which has the front, back and side panels being sequentially positioned in an adjacent side by side manner, defining the four panels, separated by fold lines. A tab may extend from the first panel which mates with the fourth panel to form the four walls in a generally rectangular configuration.

The top wall structure 28 is generally formed from four separate panels, each of which extends from one of the sidewalls or one of the front or back walls. The top wall structure 28 includes front flap 30 which extends from the front wall 20, back flap 31 which extends from the back wall 22, first side flap 32 which extends from the first sidewall 24, and second side flap 33 that extends from the second sidewall 26. Similarly, the bottom wall structure 29 includes front flap 34 extending from the front wall 20, back flap 35 extending from the back wall 22, first side flap 36 extending from the first sidewall 24, and second side flap 37 extending from the second sidewall 26.

The inner spout retaining member 19 spans between two adjacent walls so as to be spaced apart from the edge joining the two corners. Typically, as well, the inner spout retaining member 19 is perpendicular to the top and the bottom panel structures, although the same is not required. The first panel 50 spans diagonally from the first side wall 24 to the front wall 20 obliquely relative to each wall and spaced apart from a side edge joining the front wall to the first sidewall 24, to, in turn, define a generally trianglular cross-sectional configuration therebetween. In the configuration shown, the triangular cross-section defines a generally right triangle with the remaining angles being equal to each other. Such a configuration centers the first panel 50 such that the spout can be directed at the side edge between the front wall and the first sidewall.

The inner spout retaining member 19 includes first panel 50, sidewall engaging panel 52 and front wall engaging panel 53. A portion of the bottom wall structure may include a bottom encapsulating panel 56. The inner spout retaining member 19 can be formed from a blank separate from the outer carton, or as is shown in FIG. 13, along with the remainder of the blank. It is generally, therefore, formed from the same material as the remainder of the outer carton.

With reference to FIGS. 2, 3, 5, 6 7 and 13, the sidewall engaging panel 52 overlies and is glued to the first sidewall 24 about the outside surface of the inner spout retaining member. On the opposing side, the front wall engaging panel 53 overlies and is glued to the front wall about the outside surface of the front wall engaging panel. Such an assembly defines a pocket that is, in the example shown, generally of a triangular cross-sectional configuration.

The first panel 50 further includes a spout receiving slot 60 at the lower end thereof which is configured to engage a spout of a bag (or a tap coupled to the spout of a bag).

Generally, the spout receiving slot 60 is centrally located on the first panel 50 and opens toward the bottom wall structure.

With reference to FIG. 13, the bottom encapsulating panel extends from a bottom edge of one of the bottom wall structure flaps (such as the back flap). The bottom encapsulating is configured to be substantially parallel to the front panel 50 of the spout retaining member. The bottom encapsulating panel is positionable so as to be in an abutting relationship with the front panel. A spout locking slot 63 which substantially matches the spout receiving slot 60 is presented so that together they can engage and lock the spout in a generally fixed position. In certain embodiments, such a bottom encapsulating panel may be omitted (i.e., the embodiment of FIGS. 4-8).

Figure 14:
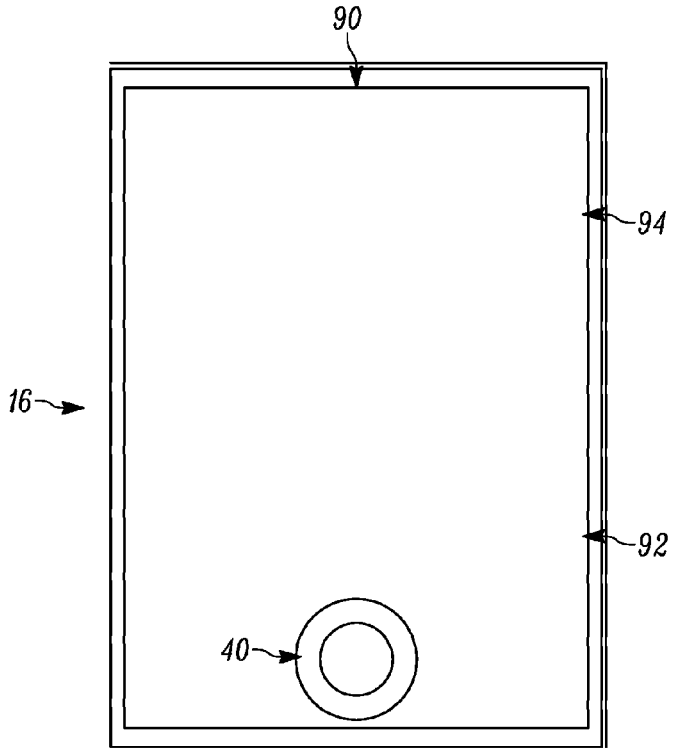
FIG. 14 of the drawings is a front view of an inner bag for use in association with the present disclosure.
Figure 15:
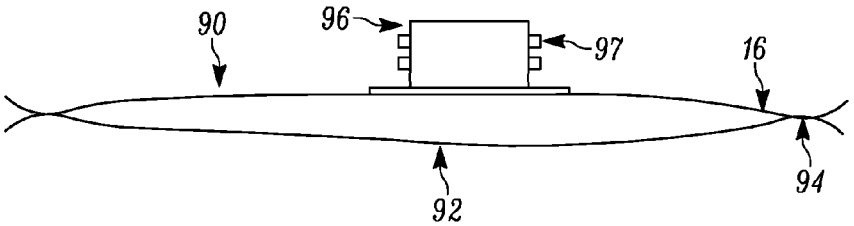
FIG. 15 of the drawings is a cross-sectional view of the inner bag of FIGS. 14.

Generally, and with reference to FIGS. 14 and 15, the inner bag 16 that is associated with such a bag in box package comprises a pillow type container having a front panel 90, a back panel 92, seals 94 that couple the front panel to the back panel to define a generally rectangular or square cavity. A spout 96 is generally coupled to an opening in the front panel 90 so as to provide ingress into the cavity. The spout includes a base flange with an upstand portion extending therefrom. The base flange is typically coupled to the bag so as to provide communication with the cavity through the upstand portion. The outer surface of the upstand portion typically includes a plurality of flanges that are spaced apart from each other. These flanges are typically parallel to each other and generally parallel to the base flange. The flanges are configured to facilitate grasping by filling equipment, and are configured to receive portions of the outer carton for releasable attachment. Typically, the front and back panels may comprise a single or multi-layer laminate or co-extrusion, and may comprise a single or multi-ply configuration. In other embodiments, a gusseted bag, or other form fitting bag can be utilized in the place of a pillow type bag. The seals may be formed in any number of different manners. Additionally, the materials selected for each of the panels and the spout can be varied depending on the particular application.

Figure 16:
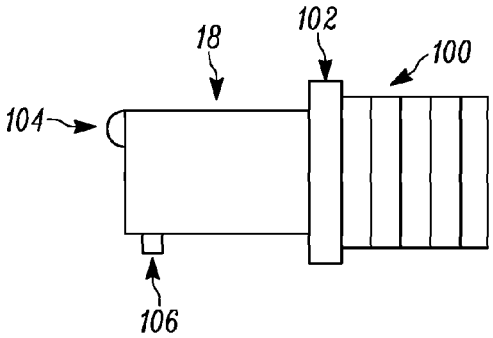
FIG. 16 of the drawings is a side elevational view of an exemplary tap of the present disclosure.

The tap 18 is shown in FIG. 16 as comprising a spout interface 100, flange 102, actuator 104 and dispensing opening 106. Any number of different configurations are contemplated for the tap, and the disclosure is not limited to any particular tap configuration, or any particular tap. For example, one such tap comprises the tap shown in any one of the following patents, namely, U.S. Pat. Nos. 4,619,377 and 6,978,981 both of which are issued to Roos as well as U.S. Pat. Nos. 6,045,119; 6,296,157 and 6,360,925 issued to Erb, as well as, the tap shown in U.S. Pat. No. 8,336,743 issued to Bellmore. Of course, other taps are likewise contemplated. The foregoing patents are incorporated by reference herein in their entirety. These taps are shown only for purposes of illustration, and are not deemed to be limiting or to in any manner limit the disclosure to the foregoing taps.

To assemble the container of the bag in box package of the present disclosure, the user is first provided with a blank or a partially folded box, such as the blank shown in FIG. 13 (which does not show an embodiment with a frangible portion that would be in place of the triangular portions described above). Once articulated, the front wall, back wall, and first and second sidewalls are fully formed. The top wall structure and the bottom wall structure remain open. The inner spout retaining member is in position and coupled to the first sidewall and the front wall. The first panel is then oblique to each of the first sidewall and the front wall, and essentially facing the edge joining the two. In the configuration shown, the outer carton is formed from a single blank of material.

The top wall structure is then assembled so as to form a three sided container with an open bottom wall structure. Generally the flaps of the bottom wall structure are folded and glued so as to be secured to each other.

Next, the bag is positioned into the cavity that is bound by the two sidewalls, the back wall, the front wall and the inner spout retaining member. As the bag is further directed inward the spout and/or the tap is directed into contact with the spout receiving slot 60 of the inner spout retaining member 19. Further direction captures the spout (generally between flanges thereof), or the tap/spout (again between flanges or a combination of the two) within the spout receiving slot 60. The bag insertion continues until the entirety of the bag is within the cavity of the box. It will be understood that this can be accomplished after the bag has been filled with a predetermined amount of flowable material.

Once fully inserted into the box, the bottom encapsulating panel 56 can be rotated so that it is directed toward the spout receiving slot and toward the spout positioned therein. Eventually, the spout locking slot 63 of the bottom encapsulating panel engages the spout and locks the spout into place. At such time, the tap generally faces directly at the edge between the first sidewall and the front wall.

Once the bottom encapsulating panel is positioned in the desired orientation, the bottom wall structure is assembled so as to seal the bag within the box. The different flaps are folded about their respective edges until they have sealed the bottom of the box.

To use the bag in box assembly, of, for example, FIGS. 1-8, the user is provided with the package. As will be understood, due to the frangible portion of the outer carton, the spout and tap remain removed from view and access. As such, the user grasps the frangible portion 40 and disconnects the same from the remainder of the outer carton. It will be understood that a number of different configurations are contemplated for the frangible portion 40 of the outer container. In certain embodiments, an angled corner cutout is contemplated, wherein the frangible portion 40 extends over the first sidewall, the front wall, and the bottom wall so as to expose the inner spout retaining member and the tap.

In another embodiment, as is shown in FIG. 13, the frangible portion may be omitted. In such an embodiment, a triangular cutout and a triangle fold are provided. The portion around the tap has been removed through a triangular cut of portions of each one of the first sidewall and the front wall. Additionally, a pair of folded triangular panel sections immediately above the triangular cutout portion are provided. When articulated inwardly, these triangular portions are configured to precisely fit the portion that is between the first panel of the inner spout retaining member and the first sidewall and the front wall. Thus, access is provided to the spout while precluding access to the front panel above the spout, and into the container. Another such folded triangular portion can be provided on the corner opposite of the corner proximate the spout and tap so as to provide a handle. In addition, openings can be provided on the outer carton immediately above the tap so as to enable grasping and holding. It will be understood that the cavity that is exposed through the openings is the open cavity that is defined by the sidewall, the front wall and the first panel of the inner spout retaining member.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A bag in box packaging comprising:

an inner bag defining a cavity with a spout coupled thereto providing communication with the cavity;

an outer carton including a front wall and a first sidewall positioned adjacent to the front wall, both extending from a bottom wall to a top wall, wherein the bottom wall and top wall are substantially parallel to each other and perpendicular to each of the front wall and the first side wall;

an inner spout retaining member including a first panel substantially perpendicular to the bottom wall, spanning diagonally from the first side wall to the front wall obliquely relative to each wall and spaced apart from a side edge joining the front wall to the first sidewall, to, in turn, define a generally uniform triangular cross-sectional configuration therebetween, the first panel including a spout retaining slot extending thereinto; and wherein the spout of the inner bag is configured to extend into the spout receiving slot so as to capture the spout within the cross-sectional configuration and directed toward the side edge, with the inner bag positioned on an opposite side of the first panel.

2. The bag in box packaging of claim 1 further comprising a member for locking the spout within the spout receiving slot.

3. The bag in box packaging of claim 2 wherein the member for locking the spout comprises a bottom encapsulating panel that extends from the bottom wall and includes a spout locking slot that engages the spout when the spout is positioned within the spout receiving slot, so as to sandwich the spout therebetween.

4. The bag in box package of claim 1 wherein the first panel extends from the bottom wall to the top wall.

5. The bag in box package of claim 4 wherein the first panel of the inner spout retaining member is generally perpendicular to the bottom wall.

6. The bag in box package of claim 5 wherein each of the front wall, the first sidewall and the first panel of the inner spout retaining member are perpendicular to the bottom wall.

7. The bag in box package of claim 1 wherein the front wall, the bottom wall and the first sidewall further include a frangible portion, whereupon removal of the frangible portion the spout becomes accessible through an opening defined thereby.

8. The bag in box packaging of claim 1 wherein the spout receiving slot includes an opening that is proximate the bottom wall.

9. The bag in box packaging of claim 8 wherein the spout receiving slot comprises a slot that extends from a bottom edge of the first panel toward the top wall.

10. The bag in box packaging of claim 1 wherein the inner spout retaining member further comprises a sidewall engaging panel coupled to one side of the first panel and a front wall engaging panel coupled to the other side of the first panel.

11. The bag in box packaging of claim 1 wherein the outer carton is formed from a single blank of material.

12. The bag in box packaging of claim 1 wherein a triangular cutout is formed between the front wall and the first sidewall proximate the bottom wall, and a pair of triangular folds are formed above the opening, wherein the triangular folds abut each other about the side edge, and wherein the triangular folds may be directed inwardly toward the first panel.

13. The bag in box packaging of claim 1 further including openings along the side edge to facilitate grasping by a user for purposes of dispensing.

14. The bag in box packaging of claim 1 wherein a tap is coupled to the spout of the inner bag.

15. The bag in box packaging of claim 1 wherein the triangular cross-sectional area comprises a right triangle with each of the remaining angles being equal.

16. The bag in box packaging of claim 1 wherein the outer carton comprises a rectangular cubic configuration.

* * * * *